US007248138B2

(12) United States Patent
Chiang et al.

(10) Patent No.: US 7,248,138 B2
(45) Date of Patent: Jul. 24, 2007

(54) MULTI-LAYER PRINTED CIRCUIT BOARD INDUCTOR WINDING WITH ADDED METAL FOIL LAYERS

(75) Inventors: Man-ho Chiang, Tsing Yi (HK); Francois Lai Chung-hang, Kwai Chung (HK)

(73) Assignee: Astec International Limited, Hong Kong (HK)

( * ) Notice: Subject to any disclaimer, the term of this patent is extended or adjusted under 35 U.S.C. 154(b) by 244 days.

(21) Appl. No.: 10/796,694

(22) Filed: Mar. 8, 2004

(65) Prior Publication Data

US 2005/0195060 A1 Sep. 8, 2005

(51) Int. Cl.
*H01F 5/00* (2006.01)

(52) U.S. Cl. ..... 336/200; 361/793; 361/782; 336/229; 336/83; 336/212; 174/260; 174/262

(58) Field of Classification Search ..... 174/260–266, 174/846; 336/200, 229, 15; 361/793, 782
See application file for complete search history.

(56) References Cited

U.S. PATENT DOCUMENTS 5,010,314 A * 4/1991 Estrov ..... 336/198
5,175,525 A * 12/1992 Smith ..... 336/83
5,521,573 A * 5/1996 Inoh et al. ..... 336/180
6,198,374 B1 * 3/2001 Abel ..... 336/200
6,211,767 B1 * 4/2001 Jitaru ..... 336/200
6,388,551 B2 * 5/2002 Morikawa ..... 336/223
6,726,615 B1 * 4/2004 Lang et al. ..... 493/405
6,759,936 B2 * 7/2004 Yeh et al. ..... 336/90
6,914,508 B2 * 7/2005 Ferencz et al. ..... 336/200
2005/0190035 A1 * 9/2005 Wang ..... 336/200

* cited by examiner

*Primary Examiner*—Tuan Dinh
*Assistant Examiner*—Hoa C. Nguyen
(74) *Attorney, Agent, or Firm*—Nixon Peabody LLP

(57) ABSTRACT

The present invention provides an electromagnetic component formed from adjacent conducting layers of a multi-layer PCB and two additional conducting layers in contact with the PCB. The inventive component includes one or more winding turns formed by connecting the multiple layers of the multi-layer PCB with conductive vias and by connecting the additional conducting layers to respective top and bottom surfaces of the PCB. In one embodiment, one of the conducting layers is soldered to a top conducting layer of the PCB and the other of the conductive layers is soldered to a bottom conducting layer of the PCB, effectively increasing the cross-sectional area of the top and bottom winding layers. In another embodiment, the additional conducting layers are separated from the adjacent conducting PCB layers by a layer of insulation, permitting the additional conducting layers to form separate winding turns. The inventive winding stack can be surface mounted to a PCB, and can be used as an inductor, or in other electromagnetic devices. The winding thus constructed is capable of accepting larger currents with lower resulting temperature increases than windings formed only from PCBs, and are less expensive to manufacture than PCB-only windings.

18 Claims, 11 Drawing Sheets

MULTI-LAYER PRINTED CIRCUIT BOARD INDUCTOR WINDING WITH ADDED METAL FOIL LAYERS

FIELD OF THE INVENTION

The present invention relates to electromagnetic components for electric circuits, such as inductors and transformers and, in particular, to the formation of one or more winding turns of an inductor using a multi-layer printed circuit board.

BACKGROUND OF THE INVENTION

Electromagnetic components such as inductors and transformers have traditionally been constructed by winding one or more conductors about a cylindrical or torroidal core. This method of construction requires that a conductor, such as a wire, be wrapped around the outer surface of the core. The resulting components are expensive and time consuming to manufacture, and do not readily lend themselves to miniaturization or automated assembly.

More recently, electromagnetic components have been constructed using printed circuit board (PCB) manufacturing techniques, where windings and individual winding turns are formed from one or more conducting layers patterned on the surface of an insulating PCB layer, or on one or more layers of a multilayer PCB. The use of PCB conductive traces as windings has several advantages over conventional, wound windings. First, the assembled PCB winding has a smaller mounting footprint than a conventional winding, since it does not need extra leads or soldering pads. Second, the PCB winding assembly is much simpler than conventional windings, since the winding and other components in the winding circuit of a multilayer PCB can be board mounted using the same reflow and automation processes used to mount other components. Third, a multi-layer PCB winding has improved reliability since the likelihood of shorting across adjacent turns of the winding is greatly reduced or substantially eliminated. It is a well known problem of prior art power chokes formed using layers of stacked metal foils separated by insulators that shorting between layers is much more likely to occur.

In a multi-layer PCB, a PCB winding is formed from a plurality of patterned conductive traces, typically of copper, each formed on a separate insulating layer of the multi-layer PCB. Each trace forms a nearly closed typically circular pattern, so as to create the electromagnetic equivalent of one turn or loop of a prior art wire formed winding. Terminal points are formed at the ends of each trace for making connections to other traces, so as to form the individual turns of the winding. For example, the pattern can be a "C" shape with a terminal point at each of the two extreme points of the C. The PCB winding is formed by connecting the traces from different layers of the PCB through the intervening insulating PCB layers. These connections are typically plated through holes or vias in the PCB insulating layers. The traces can be connected in various ways. The traces can all be connected in series to form a winding where each trace is a separate turn of the winding. In this example, the terminal ends of each trace are offset from the traces on the adjacent levels, so that the plated through holes in each level do not intersect. Two or more traces can also be connected in parallel to decrease the impedance of a particular turn of the winding. The resultant winding is a function of the way in which the conductive traces on each layer of the multi-layer PCB are connected together and coupled to external circuits.

The inductance of a winding formed using a multi-layer PCB can be increased by introducing a core of a magnetic material through an aperture formed in the PCB layers that extends through a central non-conducting region of each layer. The core is typically included as part of a housing for the multi-layer PCB winding.

Conductive leads or vias are included on one or more layers of the multi-layer PCB to enable the efficient electrical connection of such components to an external circuit, for example by surface mounting and reflow soldering of the component to other components mounted on the same PCB or to another PCB having such other circuit components. This use of a multi-layer PCB to fabricate electromagnetic components results in smaller, more easily manufactured, and more reproducible components than is possible using a winding formed from a wire wrapped about a core.

Windings constructed from two or more conducting layers of a multi-layer PCB have many advantages over conventional wire windings, but have problems that result from the structure of PCBs. One problem with multi-layer PCB windings results from their having thin conducting layers separated by insulating material. The high current carrying capacity required for some types of inductors, such as power chokes, can result in excessive heating and thus a reduced lifetime for the component. Current carrying capacity of the winding can be increased by increasing the number of PCB layers in the multi-layer PCB and connecting the conductive traces on these new layers in parallel with pre-existing conductive layers on other layers of the PCB, but this is an expensive option since the cost of an inductor formed in a multi-layer PCB is proportional to the number of layers and the weight of the copper used in each layer. To handle a high current of over 40 amps with a two or three turn winding with low loss, a PCB having eight to ten layers will require approximately 4 ounces of copper.

What is needed is an improved winding for an inductor that is formed from a multi-layer PCB and that allows for higher current flow without a corresponding increase in temperature, or alternatively allows for fewer layers in the PCB, and which provides increased manufacturing and layout efficiencies. The resulting device should be compatible with PCB surface mounting manufacturing techniques and should be less expensive than prior art devices whose windings are formed solely from multi-layer PCBs.

SUMMARY OF THE INVENTION

The present invention solves the above-identified problems of windings formed by multi-layer PCBs. In particular, a winding is provided for an electromagnetic component that is formed from a combination of multi-layer PCB conductive traces and two additional conducting layers, each preferably comprising a metal foil, that are adjacent to the PCB winding and electrically integrated into the winding. This combination of a PCB winding and two additional conducting layers provides for winding designs that can accommodate higher currents with greater efficiency.

It is one aspect of the present invention to provide an electromagnetic component formed from a multi-layer PCB. The electromagnetic component may be an inductor, a transformer, or a like device. The PCB includes a plurality of conductive traces having a curved shape and two terminal ends. Each conductive trace is formed on an insulating layer of said PCB and is positioned with respect to the other conductive traces such that the conductive traces form a stack. A plurality of conductors are used to interconnect the terminal ends of each conductive trace to form at least one turn of a winding. A conductive layer is attached to an outer surface of said PCB in a position at the top of said stack. The conductive layer has two terminal ends and approximately the same shape as said conductive traces. An additional conductor is used to connect at least one of the conductive layer terminal ends to a terminal end of at least one of the conductive traces. A second conductive layer is attached in a similar fashion to the PCB in a position at the bottom of said stack. The second conductive layer has two terminal ends and approximately the same shape as the conductive traces. At least one second conductor is also used to connect at least one of the terminal ends of the second conductive layer to one of the conductive traces in the PCB.

In one embodiment of the invention, the additional conductive layer and the adjacent conductive trace of said PCB are in conductive contact along a substantial portion of their respective surfaces as by the soldering of the conductive layer to the conductive trace. In another embodiment of the present invention, an insulator is disposed between the outer conductive trace of said PCB and the adjacent conductive layer. The conductive traces and adjacent conductive layers can be connected in various configurations, including where a plurality of conductive traces are connected by the conductors to form a first turn of the winding and wherein at least one of the plurality of conductive traces is connected by said conductors to form a second turn of said winding. Additional turns of the winding can be formed, as desired, using selected groupings of conductive traces to form the winding turns, up to a winding having a number of turns equal to the number of conductive traces and conductive layers.

It is yet another aspect of the present invention to provide an electromagnetic component wherein a core is positioned in an aperture formed in the PCB such that the core is substantially surrounded by each said conductive trace and conductive layer. Specifically, each said insulating layer of the PCB defines an aperture, wherein each said conductive trace is in the shape of a loop positioned adjacent to the perimeter of a respective one of said apertures, and wherein said conductive layer is shaped to define an aperture that corresponds to the shape of the apertures formed in said insulating layers. The core is positioned in the space defined by said apertures.

In a preferred embodiment of the present invention, the conductors used to connect the conductive traces to one another and to the conductive layers comprise plated through holes formed in the various insulating layers of said PCB.

In another embodiment of the present invention, the electromagnetic component is formed from a multi-layer PCB having a plurality of conductive traces, a first conductive layer conductively attached to the top conductive trace, and a second conductive layer conductively attached to the bottom conductive trace. Each conductive trace is formed on an insulating layer of said PCB, has a curved shape and two terminal ends, and is positioned such that said conductive traces form a stack. A plurality of conductors are used to interconnect the terminal ends of each said conductive trace to form at least one turn of a winding.

It is another aspect of the present invention to provide an electromagnetic component that conserves layout area on a PCB, is low profile and provides high power density, is compatible with printed circuit board assembly techniques, is more reliable than prior art components formed from stacked metal foils and insulators, and is less expensive than prior art devices.

A further understanding of the invention can be had from the detailed discussion of the specific embodiment below. For purposes of clarity, this discussion refers to devices, methods, and concepts in terms of specific examples. It is intended that the invention is not limited by the discussion of specific embodiments.

BRIEF DESCRIPTION OF THE DRAWING

The foregoing aspects and the attendant advantages of the present invention will become more readily appreciated by reference to the following detailed description, when taken in conjunction with the accompanying drawings, wherein:

FIG. 1A is a side view, FIG. 1B is a top view, and FIG. 1C is a sectional view taken along the line 1C-1C of FIG. 1;

Reference symbols are used in the Figures to indicate certain components, aspects or features shown therein, with reference symbols common to more than one Figure indicating like components, aspects or features shown therein.

DETAILED DESCRIPTION OF THE INVENTION

To facilitate its description, the invention is described below in terms of inductors having windings whose turns are formed by traces, each of which are patterned on the surface of a different insulating layer of a multi-layer PCB, and wherein at least one winding turn includes two conductive layers that are not a PCB trace. In general, the present invention provides an electromagnetic component that is formed using a multi-layer PCB, where the component can comprise an inductor, including but not limited to power chokes, or the like.

The inventive PCB winding includes a plurality of conductive layers or traces wherein each conductive trace is formed on an insulating layer of said PCB and is positioned with respect to the other conductive traces such that the conductive traces form a stack. An additional conductive layer, such as a metal foil, is attached to an outer surface of the PCB. The additional conductive layer can form a separate loop of the winding, or can be connected in parallel with a PCB layer to form a single winding loop of greater cross-sectional area. The connection of an additional conductive layer to the conductive PCB layers allows for improved performance since it enables the use of low profile multi-layer PCBs having a fewer number of conducting layers while maintaining the same or better current carrying capacity. The inventive winding can include any number of turns, as is known in the art. The scope of the invention is therefore not limited by the following embodiments and examples.

Figure 1A:
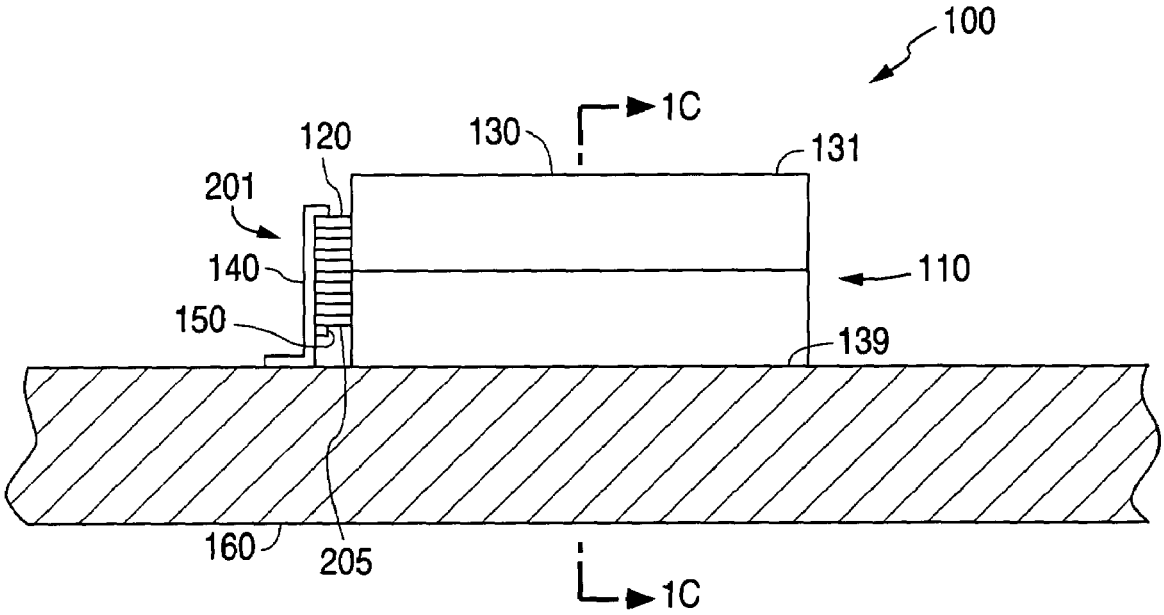
FIGS. 1A-1C are several views of an inductor according to the present invention, where
Figure 1B:
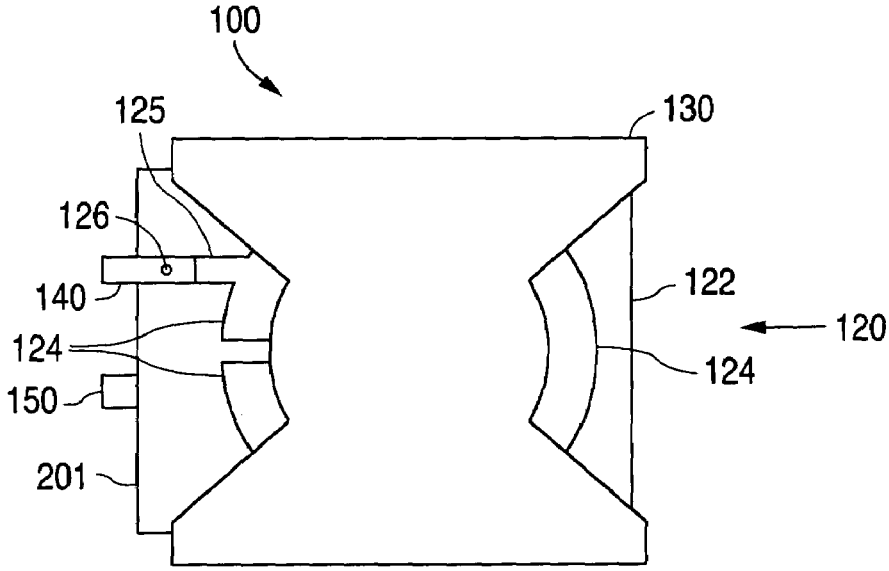
Figure 1C:
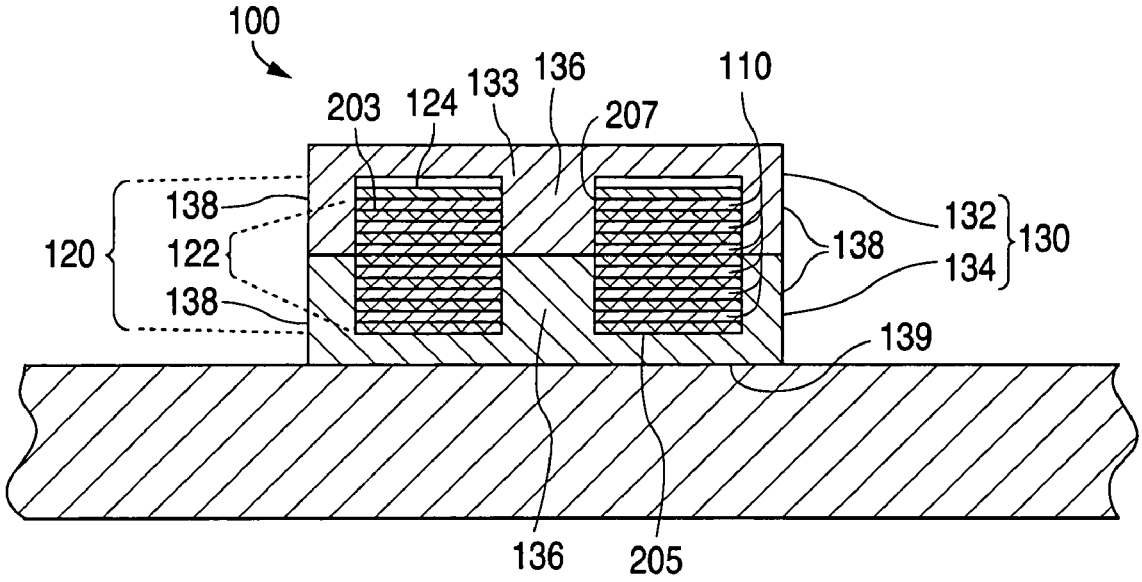
Figure 2:
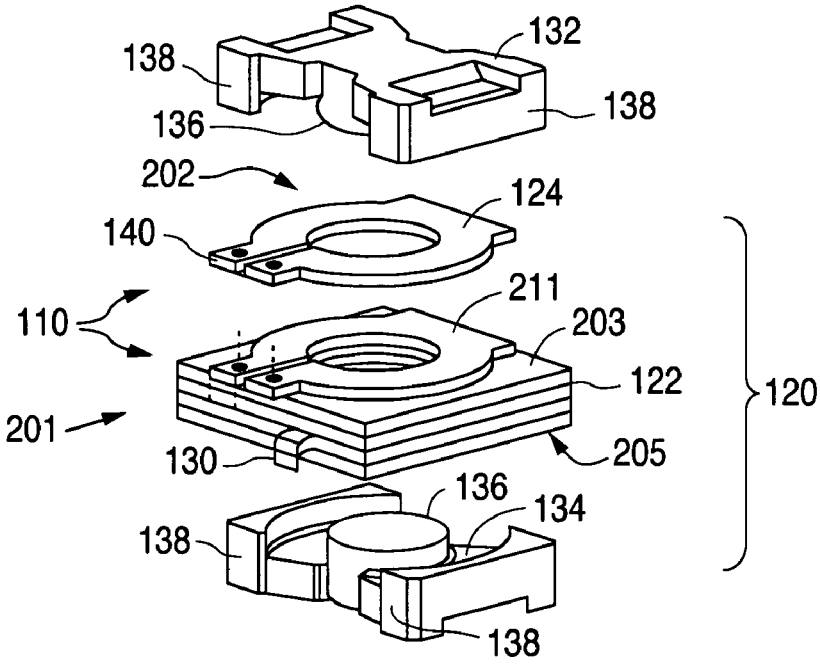
FIG. 2 is an exploded perspective view the embodiment of FIGS. 1A-1C.

The present invention will now be described in more detail with reference to the Figures. FIGS. 1A-1C and 2 are several views of an inductor 100 of the present invention that is shown in one example as being mounted on a separate main PCB 160, where FIG. 1A is a side view, FIG. 1B is a top view, FIG. 1C is a sectional view, and FIG. 2 is an exploded perspective view. As shown in FIG. 10, described below, in the preferred implementation of the multi-layer PCB inductor according to the present invention, the PCB is an integral part of the PCB used to mount and interconnect the other components of the circuit in which the inductor is one component. Thus, no separate PCB 160 is needed.

The inductor 100 includes a winding 110 having one or more turns that is formed from a stack 120 of conducting and insulating elements, as described below, a housing 130, and terminals 140 and 150 providing electrical connections from the stack to PCB 160. Inductors according to the present invention can be incorporated into circuits, including but not limited to power converter circuits, or the like.

FIG. 2 is an exploded perspective view of an inductor according to the present invention. As shown in FIGS. 1C and 2, stack 120 includes a multi-layer PCB 122 having a top surface 203 and a bottom surface 205, and an adjacent layer 124, which includes a conducting material, connected to top surface 203. Specifically, layer 124 includes a conducting layer, preferably a copper foil. As will be discussed below, layer 124, which may also include an insulating layer between the layer and PCB 122, is connected to the traces in PCB 122 so as to form one of the turns in winding 110, and thereby increase the current carrying capability of inductor 100.

An aperture 207 is formed through stack 120, and includes a central opening through the multi-layer PCB 122 and the adjacent layer 124. As best seen in FIG. 1A, stack 120 also has a side 201 where terminals 140 and 150 are provided for connecting winding 110 to an external circuit. In a preferred embodiment, a second layer of conducting material, as described below, corresponding to layer 124 and also having an opening that corresponds to the dimensions of aperture 207 is connected to bottom surface 205 of PCB 122 to provide a second additional conductive layer to further enhance the current carrying capacity of winding 110.

In general, the one or more turns that form winding 110 are formed from individual or interconnected ones of conducting layers of multi-layer PCB 122 and layer 124. Specifically, a plurality of conducting layers of multi-layer PCB 122, the topmost conducting layer indicated as a conductive layer 211, as seen in FIG. 2, and a conducting layer 124 on top of conducting layer 211 are electrically interconnected in a manner dictated by the type of winding 110 a given user desires.

As shown in FIGS. 1A and 1C, a housing 130 surrounds stack 120 and forms a core 133 that is sized to fit in aperture 207. Housing 130 also includes an outer shell 131 having a bottom surface 139 that is designed to mount on PCB 160. A preferred embodiment of housing 130 is shown in greater detail in FIGS. 1C and 2 as including an upper core member 132 and a lower core member 134 that each have a central leg 136 and a pair of corresponding outer legs 138. The central legs 136 of members 132 and 134 form core 133, and the outer legs 138 of member 132 and 134 meet on the outside of stack 120, to form outer shell 131 of housing 130.

Figure 3:
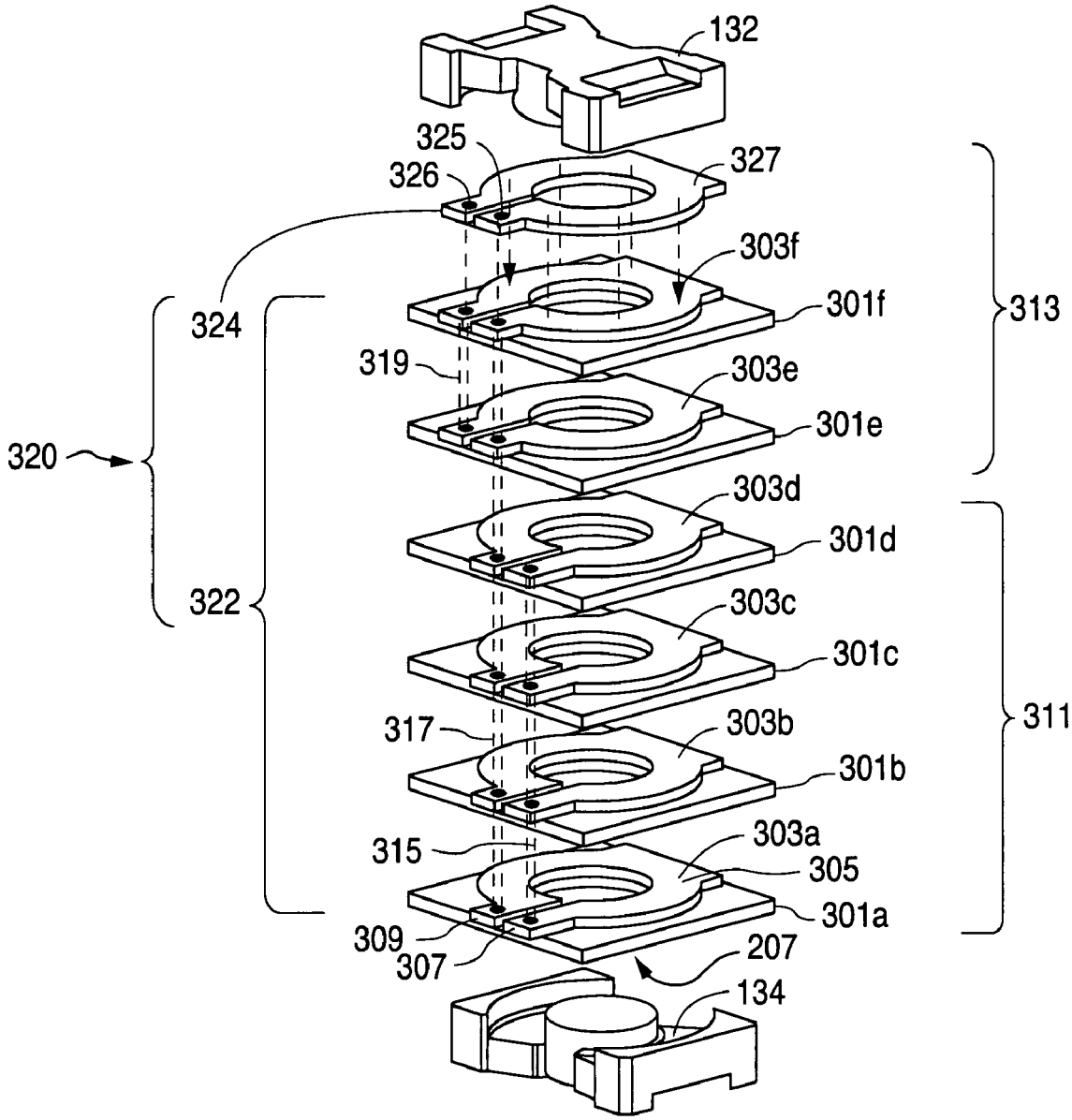
FIG. 3 is an exploded perspective view of an embodiment of an inductor according to the present invention wherein the PCB has six layers and the inductor has two turns.
Figure 4:
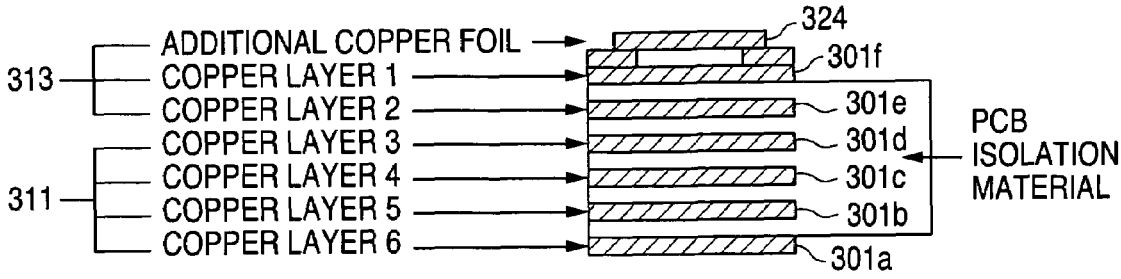
FIG. 4 is a sectional view of the embodiment of FIG. 3.
Figure 5:
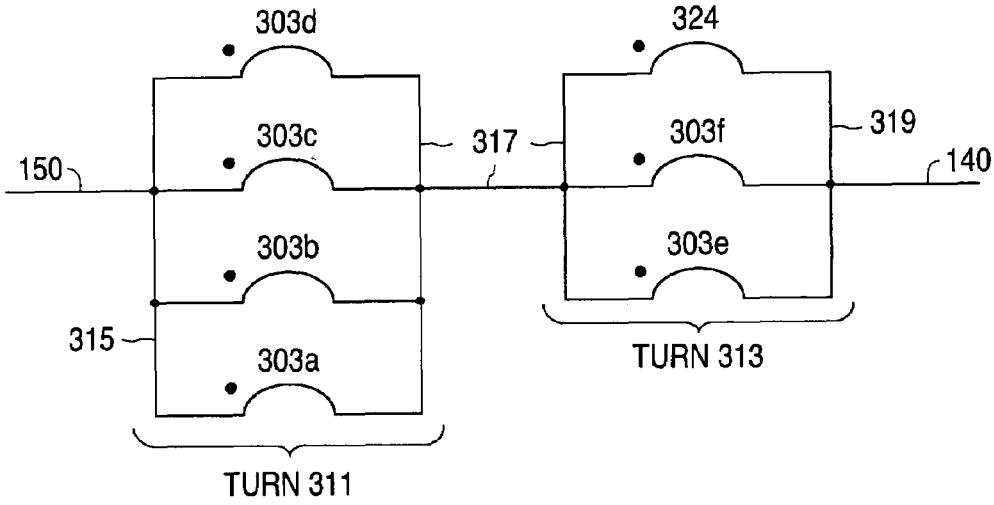
FIG. 5 is a circuit diagram of the embodiment of FIG. 3.

An embodiment of an inductor according to the present invention formed on a six layer PCB and having two winding turns is shown in the exploded perspective view of FIG. 3, in the sectional view of FIG. 4, and in the circuit diagram of FIG. 5. As seen in these figures, a winding 320 includes a conducting layer 324 and a multi-layer PCB 322 that are connected to form a first turn 311 of said winding that includes four PCB layers and a second turn 313 of said winding that includes two PCB layers. Multi-layer PCB 322 has six alternating insulating layers 301 and conducting layers 303, with layer 324 soldered to one of layers 303, thus increasing the thickness of winding turn 313. As illustrated in FIG. 3 with reference to conducting layer 303*a*, each conducing layer 303 has a curved portion 305 that is positioned about aperture 207. Curved portion 305 terminates in a first end 307 and a second end 309. Layer 324 also has a curved portion 327 that is positioned about aperture 207 and terminates at a first end 325 and a second end 326. Ends 307 and 309 are interconnected through the insulating layers 301 in a conventional fashion by one or more plated through holes formed therein, indicated in FIG. 3 as dashed lines. Specifically, a first plated through hole 315 connects a first subset of layers 303 and is connected to a terminal 150. A second plated through hole 317 connects a second subset of layers 303. A third plated through hole 319 connects a third subset of layers 303 and is connected to a terminal 140. Each of these plated through holes is preferably formed using a large number of plated micro-vias to increase conductivity of the conductor formed between the conductive traces on adjacent layers of PCB 322. These micro-vias may also accept solder, thereby further increasing the conductivity of the vias.

More specifically, as shown in FIGS. 3 and 4, multi-layer PCB 322 includes: conducting layer 303*a* between insulating layers 301*a* and 301*b*; conducting layer 303*b* between insulating layers 301*b* and 301*c*; conducting layer 303*c* between insulating layers 301*c* and 301*d*; conducting layer 303*d* between insulating layers 301*d* and 301*e*; conducting layer 303*e* between insulating layers 301*d* and 301*f*; and conducting layer 303*f* on top of insulating layer 301*f*. Conducting layers 303 and layer 324 are connected as follows: a first plated through hole 315 through insulating layers 301*b*-301*d* connects one end of conducting layers 303*a*-303*d*, a second plated through hole 317 through insulating layers 301*b*-301*f* connects the other end of conducting layers 303*a*-303*d* to one end of layers 301*e* and 301*f*; and a third plated through hole 319 through insulating layer 301*f* connects the other end of conducting layers 303*e* and 303*f*. Layer 324, which is a copper foil, is soldered directly onto conducting layer 303*f*, preferably using a single reflow soldering step. Layer 324 also has a first end 325 soldered to plated through hole 317 and a second end 326 soldered to second plated through hole 319.

The conducting layers connected as described above result in a winding 320 according to the circuit diagram of FIG. 5, where first turn 311 is formed by conducting layers 303*a*-303*d* wired in parallel, and second turn 313 is formed by conducting layers 303*d*-303*f* and layer 324 wired in parallel. Plated through holes 315, 317, and 319 are also shown schematically in FIG. 5, as well as terminals 140 and 150. The additional layer 324 of turn 313 allows for this turn to accept a greater current even though only two PCB layers are used.

Figure 6:
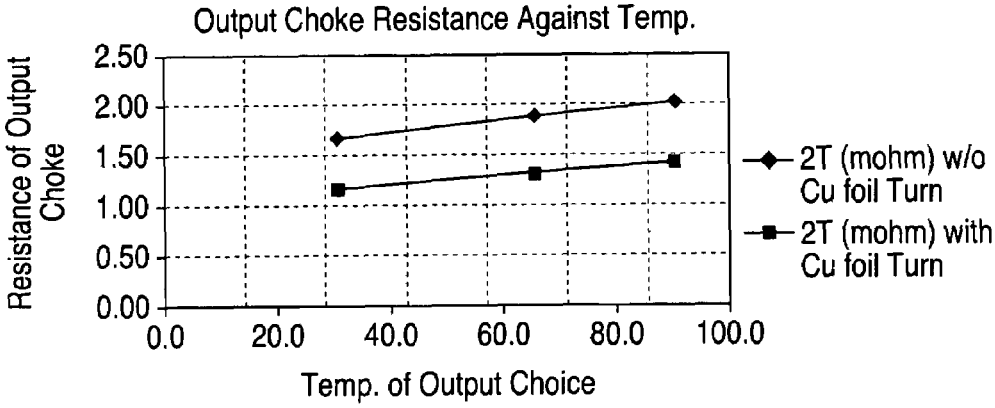
FIG. 6 is a graph showing the effect of the addition of a copper foil layer on the temperature rise in a two-turn inductor.

FIG. 6 is a graph showing the variation of resistance with temperature for a two-turn PCB winding and a two-turn PCB winding having an additional copper foil layer according to the present invention. The PCB windings have a thickness of 0.3 mm, and the copper foil layer has a thickness of 0.6 mm. In general, the temperature of the winding increases with resistance, and the resistance of the PCB traces and foil combination has a lower resistance than the PCB traces alone. Since an increased resistance further increases the winding temperature due to resistive losses, the additional foil layer allows the inductor to operate at a reduced temperature increase for a given current, or to accept a larger current with the same temperature increase, thus increasing its efficiency.

Specifically, the use of a 0.6 mm foil provides approximately the same inductive effect as two PCB layers. The cost of the foil layer is much less than the cost of two additional layers on a multi-layer PCB assembly, however, resulting in a significant cost saving when the copper foil is used as one turn of the winding. In addition to having a lower cost, the exemplary inductor formed from a 6-layer PCB plus a copper foil has the advantage of being able to operate at a lower temperature, for a given current, or to accept a larger current and operate at the same temperature as an 8-layer PCB inductor.

Figure 7:
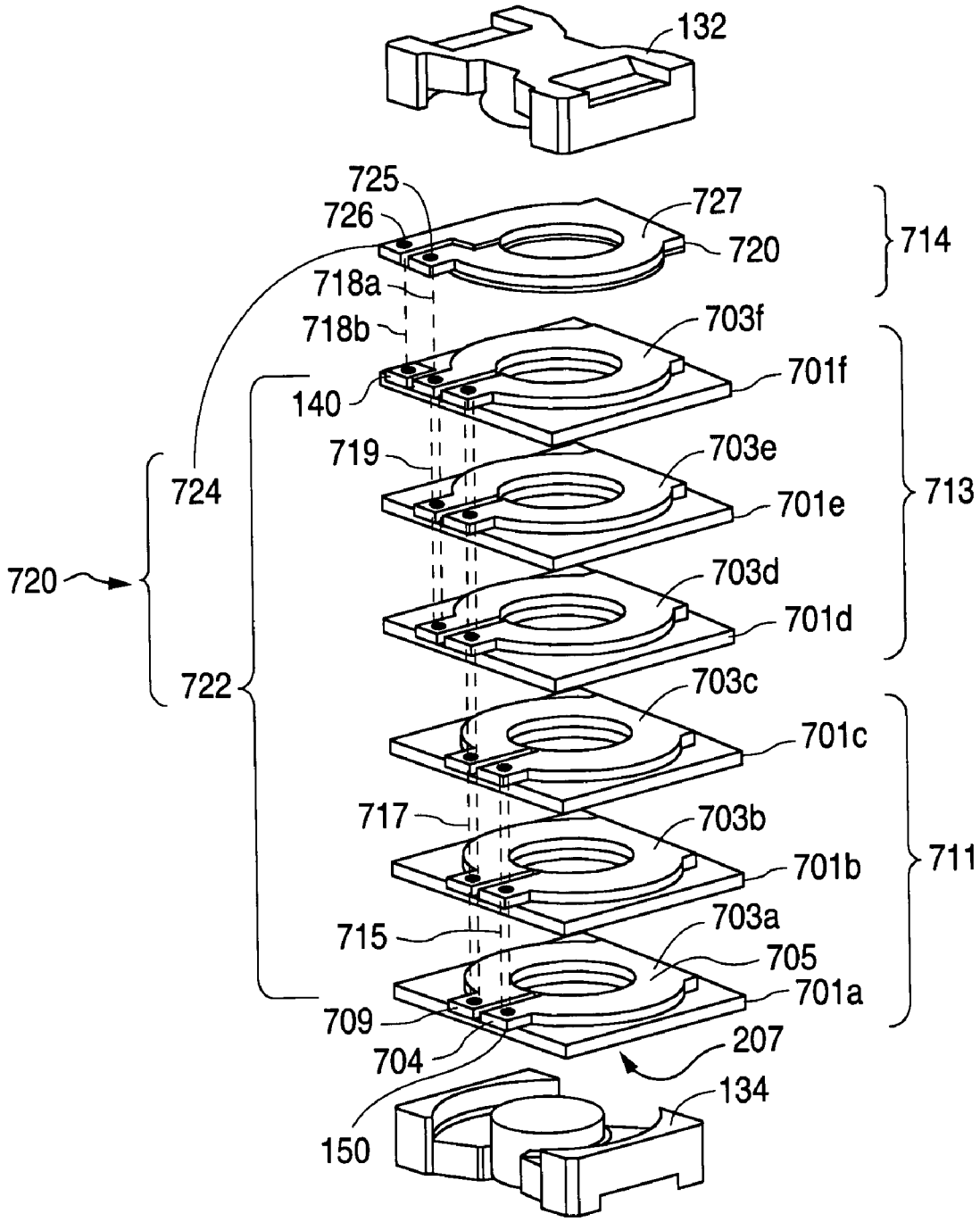
FIG. 7 is an exploded perspective view of an embodiment of an inductor according to the present invention wherein the PCB has six layers and the inductor has three turns.
Figure 8:
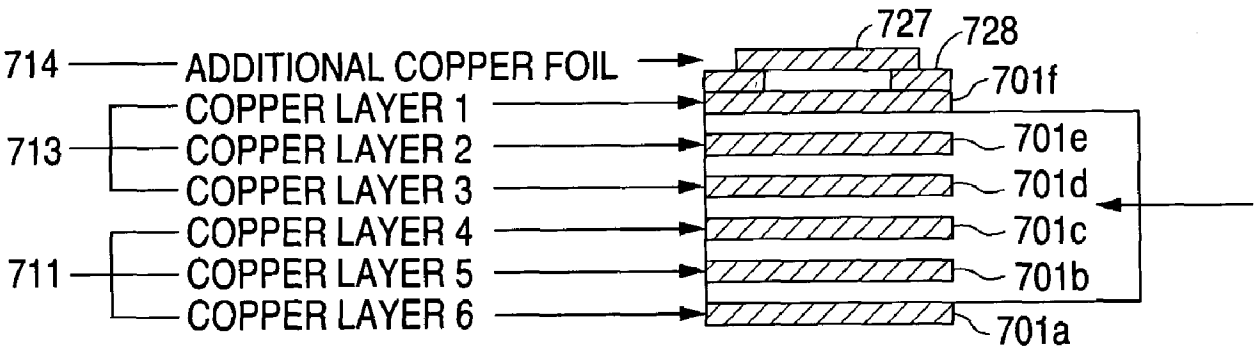
FIG. 8 is a sectional view of the embodiment of FIG. 7.
Figure 9:
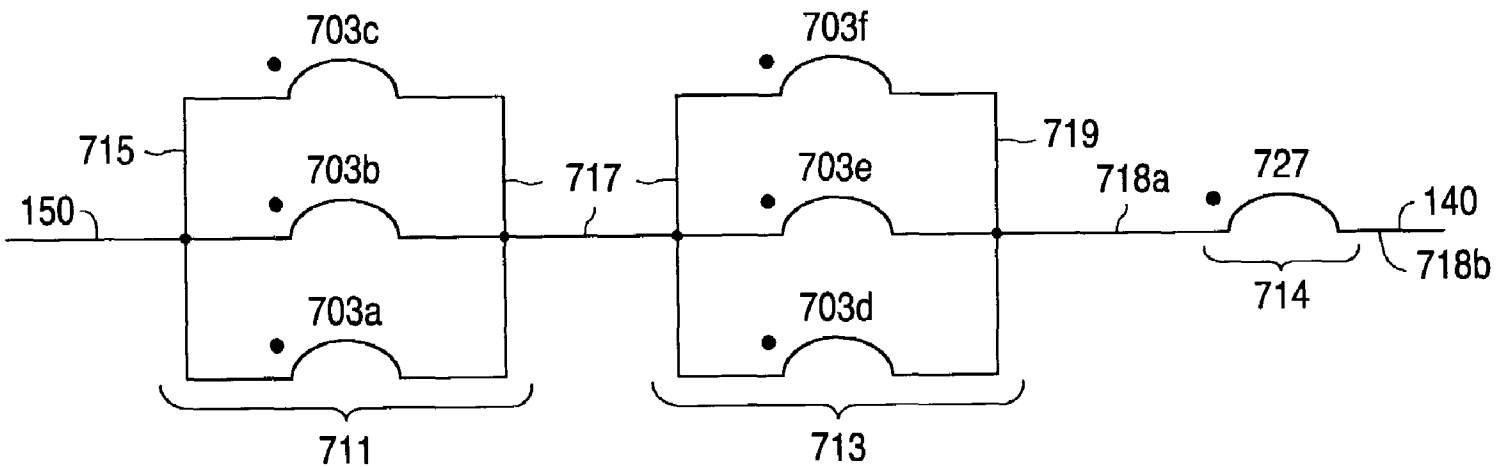
FIG. 9 is a circuit diagram of the embodiment of FIG. 7.

Another embodiment illustrative of the many winding configurations that are within the scope of the present invention is illustrated by winding 720 which is shown in the exploded perspective view of FIG. 7, in the sectional view of FIG. 8, and in the circuit diagram of FIG. 9. As seen in these figures, winding 720 is a three-turn winding wherein the six layers of a multi-layer PCB 722 form two of the turns and where an additional conducting layer forms a third turn. Specifically, winding 720 includes a layer 724 and a multi-layer PCB 722 that are connected to form a first turn 711 having three traces, a second turn 713 having two traces, and a third turn 714 formed by layer 724.

Multi-layer PCB 722 has alternating insulating layers 701 and conducting layers 703, and layer 724 includes a conducting layer 727 and an insulting layer 728. As illustrated in FIG. 7 with reference to conducting layer 703*a*, each conducting layer 703 has a curved portion 705 that is positioned about aperture 207. Curved portion 705 terminates in a first end 707 and a second end 709. Conducting layer 727 also has a curved portion that is similarly positioned about aperture 207 and terminates at a first end 725 and a second end 726. Ends 707 and 709 are interconnected through the insulating layers 701 in a conventional fashion by one or more plated through holes formed therein, indicated in FIG. 7 as dashed lines. Specifically, a first plated through hole 715 connects a first subset of conducting layers 703 and is connected to a terminal 150. A second plated through hole 717 connects a second subset of conducting layers 703. A third plated through hole 719 connects a third subset of conducting layers 703. Plated through hole 719 also connects to first end 725 of conductive layer 727, as shown at 718*a*. The second end 126 of conductive layer 727 is connected to a terminal 140, as shown at 718*b*. As in the other embodiment described above, each plated through hole in PCB 722 is preferably formed using a large number of micro-vias.

More specifically, as shown in FIGS. 7 and 8, multi-layer PCB 722 includes: conducting layer 703*a* between insulating layers 701*a* and 701*b*; conducting layer 703*b* between insulating layers 701*b* and 701*c*; conducting layer 703*c* between insulating layers 701*c* and 701*d*; conducting layer 703*d* between insulating layers 701*d* and 701*e*; conducting layer 703*e* between insulating layers 701*d* and 701*f*; and conducting layer 703*f* on top of insulating layer 701*f*. Conducting layers 703 and layer 727 are connected as follows: a first plated through hole 715 through insulating layers 701*b*-701*c* connects one end of conducting layers 703*a*-703*c* to terminal 150, a second plated through hole 717 through insulating layers 701*b*-701*f* connects the other end of conducting layers 703*a*-703*c* to one end of layers 703*d*-703*f*, and a third plated through hole 719 through insulating layer 701*e* and 701*f* connects the other end of conducting layers 703*d*-703*f*. Layer 724 includes insulating layer 728 on top of conducting layer 701*f*, and conducting layer 727 on top of insulating layer 728 to insulate conducting layers 701*f* and 727. Conducting layer 727, which is preferably a conducting layer copper foil, is connected through insulating layer 727 to conducting layer 701*f* at a first end 725 preferably by a first plated through hole 718*a*. A second plated through hole 718*b* connects second end 726 to terminal 140.

The conducting layers connected as described above result in a winding 720 according to the circuit diagram of FIG. 9, where the first and second turns (711 and 713) are formed from the multi-layer PCB 722 and the third turn 714 is formed from the additional layer 724. Specifically, where first turn 711 is formed by conducting layers 703*a*-703*c* wired in parallel, second turn 713 is formed by conducting layers 703*d*-703*f* wired in parallel, and third turn 714 is formed by layer 727. Plated through holes 715, 717, 719, 718*a* and 718*b* are also shown schematically in FIG. 9, as well as terminals 140 and 150.

Figure 10B:
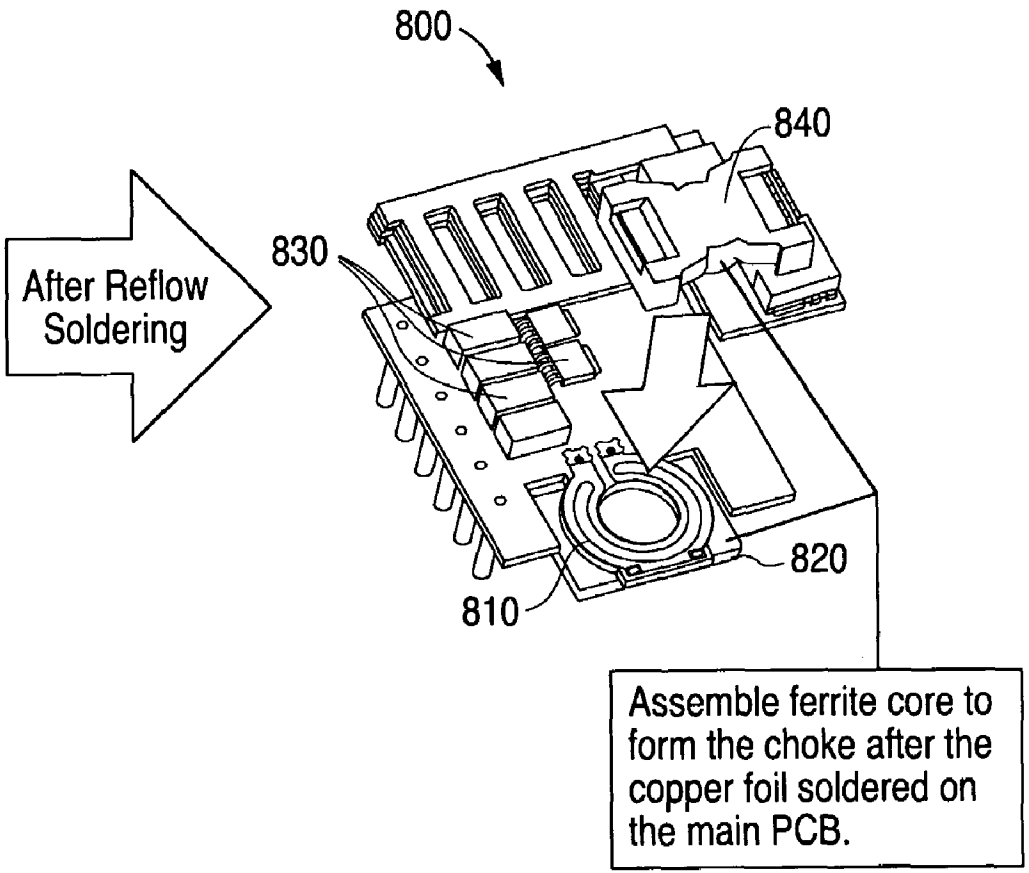
FIGS. 10A and 10B are partially exploded perspective views of an exemplary PCB according to the present invention illustrating the reflow soldering process used to connect a copper foil layer to the multi-layer PCB
Figure 10A:
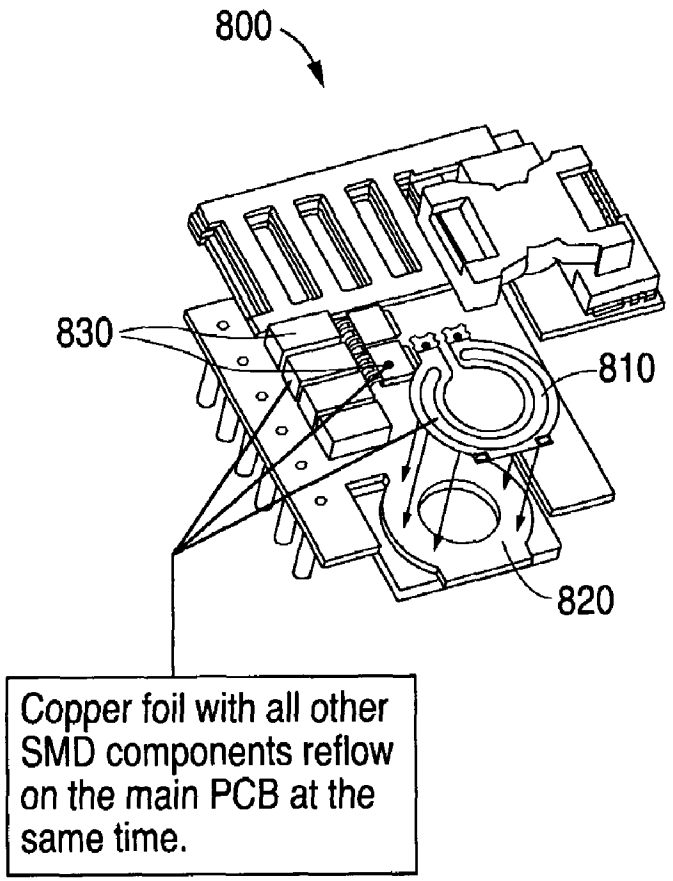

FIGS. 10A and 10B provide partially exploded perspective views of an exemplary PCB assembly 800 according to the present invention illustrating the reflow soldering process used to connect a copper foil layer 810 to the multi-layer PCB 820. As seen in FIG. 10A, the multi-layer PCB is an integral part of a larger multi-layer PCB that includes other components, as shown at 830, mounted thereon. The metal foil conductive layer 810 is connected to the surface of the PCB, in a position above the stack of conductive traces formed in the PCB, during a conventional reflow soldering process. As seen in FIG. 10B, after the metal foil 810 is attached to the surface of the PCB 820 in this manner, a ferrite core and housing 840 for the inductor component is installed around the conductive traces and conductive layer, as above described.

Figure 11C:
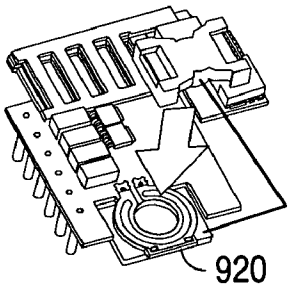
FIGS. 11A, 11B, and 11C are partially exploded perspective views of an exemplary PCB according to the present invention wherein the PCB has six layers and wherein two conductive layers are attached to the PCB, with FIG. 11A showing the conductive layers before attachment to the PCB and FIG. 11C showing the conductive layers after attachment.
Figure 11B:
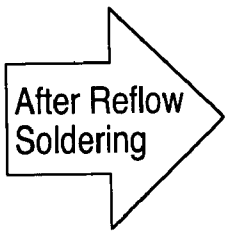
Figure 11B:
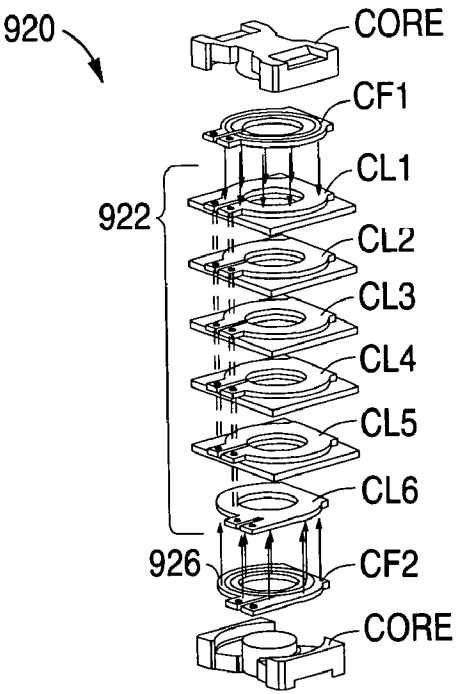
Figure 11A:
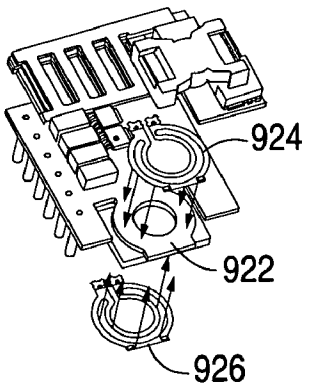
Figure 12:
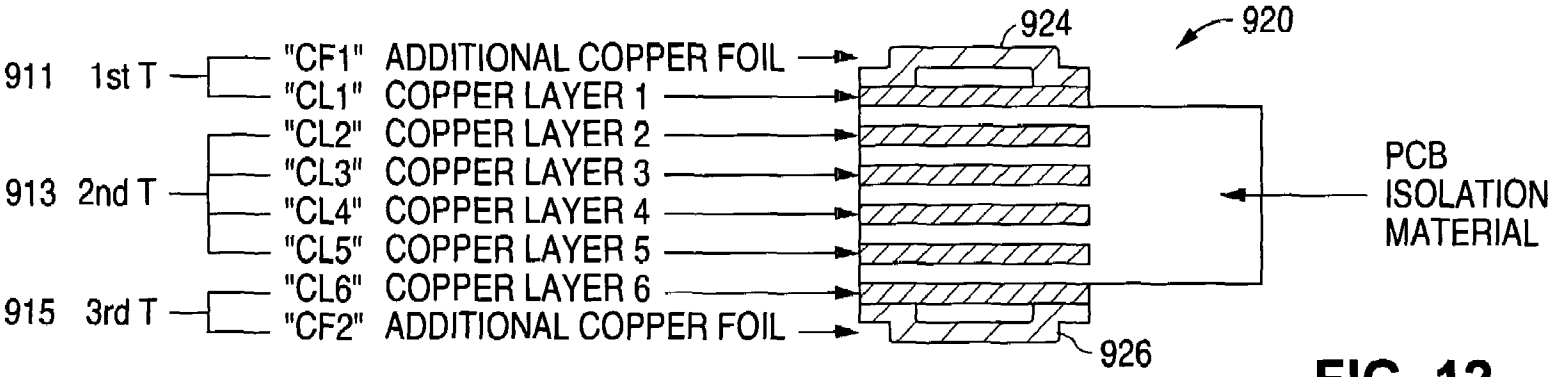
FIG. 12 is a sectional view of the embodiment of FIG. 11.

FIGS. 11A, 11B, and 11C are partially exploded perspective views of an exemplary PCB according to the present invention wherein the PCB has six layers and wherein two conductive layers are attached to the PCB, with FIG. 11A showing the conductive layers before attachment to the PCB and FIG. 11C showing the conductive layers after attachment. FIG. 12 is a sectional view of the embodiment of FIG.

Figure 13:
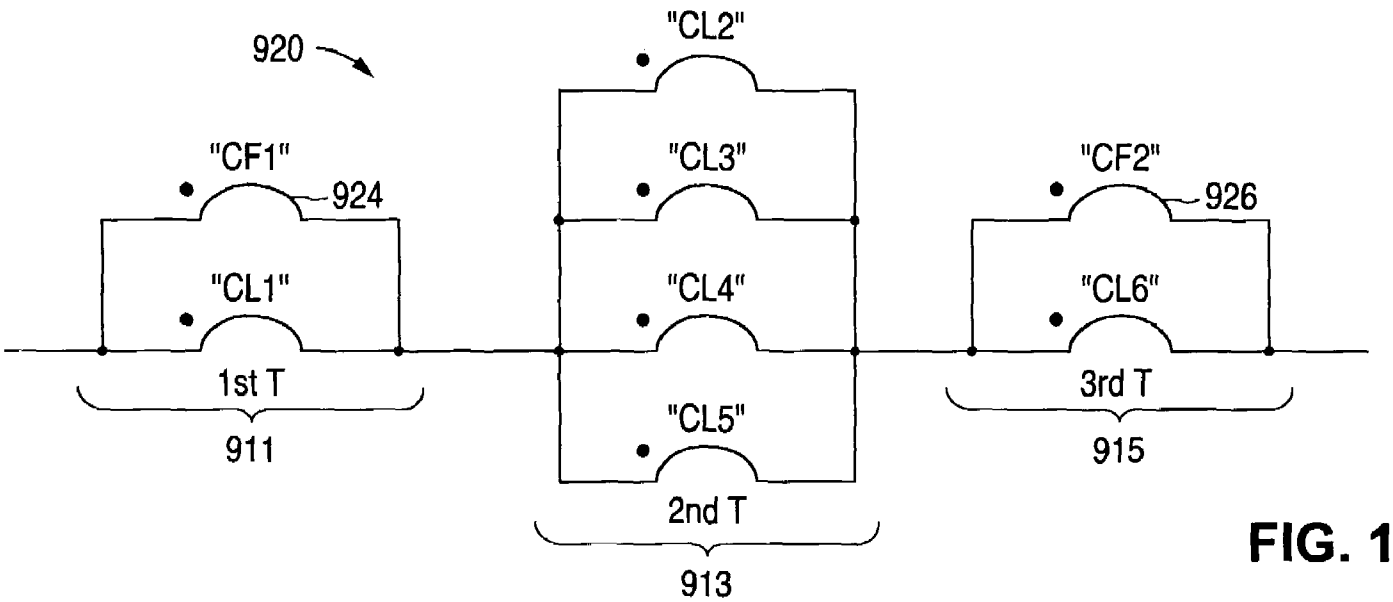
FIG. 13 is a circuit diagram of the embodiment of FIG. 11, showing an inductor winding having three turns.

11 and FIG. 13 is a circuit diagram of the embodiment of FIG. 11, showing an inductor winding having three turns.

As seen in FIGS. 11-13, a winding 920 is formed by a PCB 922 and two separate conductive layers attached thereto, as shown in the exploded perspective view of FIG. 11B, in the sectional view of FIG. 12, and in the circuit diagram of FIG. 13. As seen in these figures, winding 920 is a three-turn winding wherein the six layers CL1-CL6 of multi-layer PCB 922 form three turns in conjunction with the two additional conducting layers. Specifically, winding 920 includes a first conductive layer 924, a second conductive layer 926, and six layers of multi-layer PCB 922. These layers are connected to form a first turn 911 having one trace CL1 and layer 924, a second turn 913 having four traces CL2-CL5, and a third turn 915 formed by the bottom trace CL6 of PCB 922 and layer 926.

Multi-layer PCB 922 has alternating insulating layers and conducting layers as described above for the other embodiments of an inductor according to the present invention. As also described above, each conductive layer is preferably connected by means of conductors formed as plated through holes in said insulators.

Figure 14:
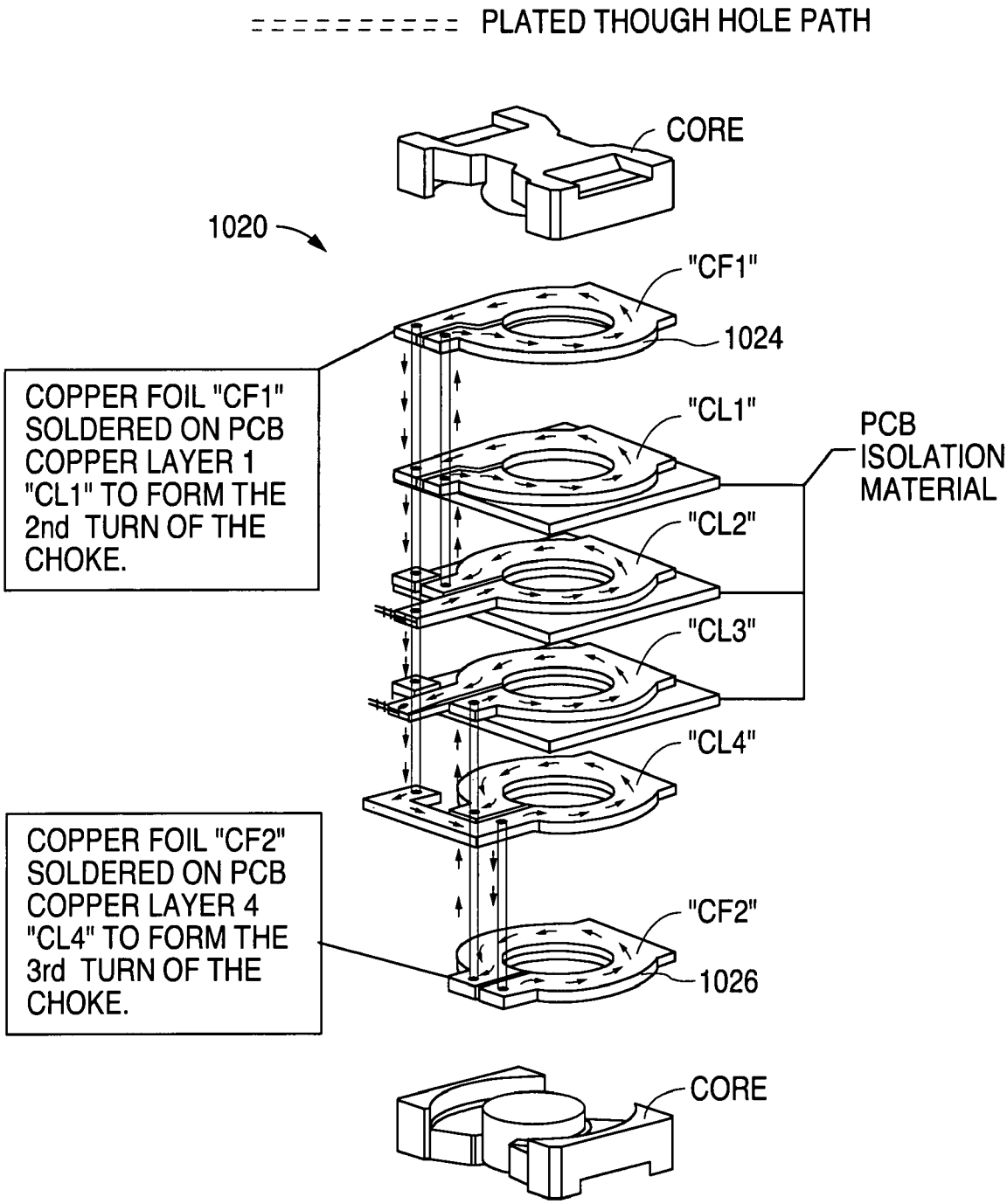
FIG. 14 is an exploded perspective view of an embodiment of an inductor according to the present invention wherein the PCB has four layers and the inductor winding has four turns.
Figure 15:
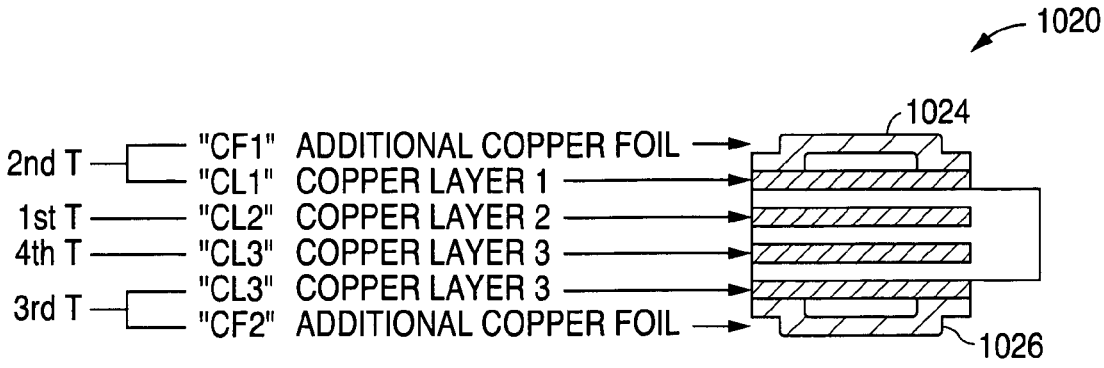
FIG. 15 is a sectional view of the embodiment of FIG. 14.

FIG. 14 is an exploded perspective view of an embodiment of an inductor according to the present invention wherein two conductive layers are attached to the PCB and wherein the PCB has four layers and the inductor winding has four turns. FIG. 15 is a sectional view of the embodiment of FIG. 14, and FIG. 16 is a circuit diagram of the embodiment of FIG. 14 showing an inductor winding having four turns.

Figure 16:
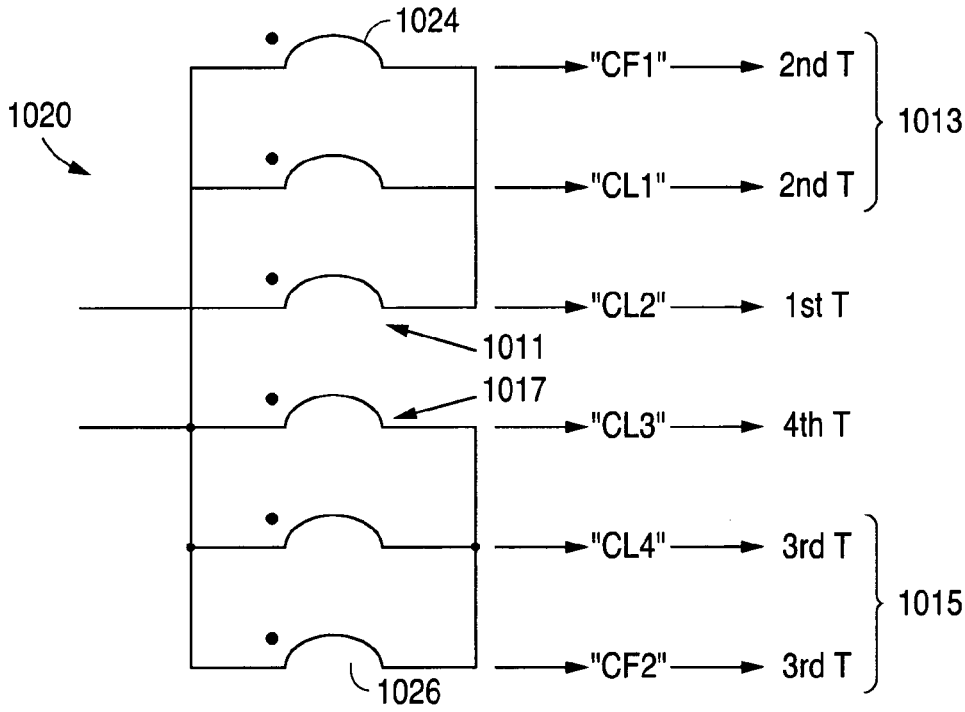
FIG. 16 is a circuit diagram of the embodiment of FIG. 14.

As seen in FIGS. 14-16, a winding 920 is formed by a PCB 1022 and two separate conductive layers attached thereto, as shown in the exploded perspective view of FIG. 14, in the sectional view of FIG. 15, and in the circuit diagram of FIG. 16. As seen in these figures, winding 1020 is a four turn winding wherein the four layers CL1-CL4 of multi-layer PCB 1022 form four turns in conjunction with the two additional conducting layers. Specifically, winding 1020 includes a first conductive layer 1024, a second conductive layer 1026, and four layers of multi-layer PCB 1022. These layers are connected to form a first turn 1011 having one trace CL2, a second turn 1013 having one trace CL1 and layer 1024, a third turn 1015 having one trace CL4 and layer 1026, and a fourth turn having one trace CL3.

Multi-layer PCB 1022 has alternating insulating layers and conducting layers as described above for the other embodiments of an inductor according to the present invention. As also described above, each conductive layer is preferably connected by means of conductors formed as plated through holes in said insulators.

The invention has now been explained with regard to specific embodiments. Variations on these embodiments and other embodiments may be apparent to those of skill in the art. It is therefore intended that the invention not be limited by the discussion of specific embodiments. It is understood that the examples and embodiments described herein are for illustrative purposes only and that various modifications or changes in light thereof will be suggested to persons skilled in the art and are to be included within the spirit and purview of this application and scope of the appended claims.

What is claimed is:

1. An electromagnetic component comprising:

a plurality of conductive traces having a curved shape and two terminal ends, each conductive trace formed on an insulating layer and positioned such that said conductive traces form a multi-layer PCB stack, wherein a first one of said conductive traces is formed on the top surface of said PCB stack and a second one of said conductive traces is formed on the bottom surface of said PCB stack;

a plurality of conductors for interconnecting the terminal ends of each said conductive trace to form at least one turn of a winding;

a first separate conductive layer attached to a first outer surface of said PCB stack in a position at the top of said PCB stack and having two terminal ends and approximately the same shape as said conductive traces;

a first additional conductor for connecting at least one of said first separate conductive layer terminal ends to a terminal end of at least one of said conductive traces;

a second separate conductive layer attached to a second outer surface of said PCB stack in a position at the bottom of said PCB stack and having two terminal ends and approximately the same shape as said conductive traces; and a second additional conductor for connecting at least one of said second separate conductive layer terminal ends to a terminal end of at least one of said conductive traces.

2. The component of claim 1, wherein said first separate conductive layer is in conductive contact with said top conductive trace and said second separate conductive layer is in conductive contact with said bottom conductive trace.

3. The component of claim 2, wherein said first and second separate conductive layers are soldered directly onto, respectively, said top conductive trace and said bottom conductive trace.

4. The component of claim 1, wherein each said conductive layer is a metal foil.

5. The component of claim 1, wherein each said insulating layer defines an aperture, wherein each said conductive trace is in the shape of a loop positioned adjacent to the perimeter of a respective one of said apertures, and wherein said conductive layers are each shaped to define an aperture that corresponds to the shape of the apertures formed in said insulating layers, said component further comprising a core positioned in the space defined by said apertures.

6. The component of claim 1, wherein the component is an inductor.

7. The component of claim 1, wherein a plurality of conductive traces are connected by said conductors to form a first turn of said winding, and wherein at least one of said plurality of conductive traces is connected by said conductors to form a second turn of said winding.

8. The component of claim 7, wherein said second turn of said winding includes at least two of said plurality of conductive traces.

9. The component of claim 7, wherein at least one of said plurality of conductive traces is connected by said conductors to form a third turn of said winding.

10. The component of claim 9, wherein said third turn of said winding includes at least two of said plurality of conductive traces.

11. The component of claim 1, wherein said electromagnetic component further comprises an insulator disposed between said first one of said conductive traces formed on the top surface of said PCB stack and said first separate conductive layer, wherein said insulator is separate from any other structure of said component.

12. The component of claim 11, wherein each said insulating layer defines an aperture, wherein each said conductive trace is shaped to substantially surround the perimeter of a respective one of said apertures, and wherein said first separate conductive layer and said insulator define an aperture that corresponds to the shape of the apertures formed in said insulating layers, said component further comprising a core positioned in the space defined by said apertures.

13. The component of claim 11, wherein said first separate conductive layer forms a first turn of said winding, and wherein a plurality of conductive traces are connected by said conductors to form a second turn of said winding.

14. The component of claim 13, wherein at least one of said plurality of conductive traces is connected by said conductors to form a third turn of said winding.

15. The component of claim 14, wherein said third turn of said winding includes at least two of said plurality of conductive traces.

16. The component of claim 1 wherein said plurality of conductors comprise at least one plated through hole formed in each said insulating layer.

17. An electromagnetic component comprising:

a plurality of conductive traces having a curved shape and two terminal ends, each conductive trace formed on an insulating layer and positioned such that said conductive traces form a multi-layer PCB stack, and wherein a first one of said conductive traces is formed on the top surface of said PCB stack and a second one of said conductive traces is formed on the bottom surface of said PCB stack;

a plurality of conductors for interconnecting the terminal ends of each said conductive trace to form at least one turn of a winding;

a first separate conductive layer conductively attached to said first one of said conductive traces; and a second separate conductive layer conductively attached to said second one of said conductive traces.

18. The component of claim 4, wherein each said metal foil has a thickness that is greater than the thickness of each of said conductive traces of the multi-layer PCB stack.

* * * * *